US010390561B2

(12) United States Patent
Nersing et al.

(10) Patent No.: US 10,390,561 B2
(45) Date of Patent: Aug. 27, 2019

(54) CONTAINER

(71) Applicant: Fiedler & Lundgren AB, Malmo (SE)

(72) Inventors: Lovisa Nersing, Dalby (SE); Adam Berggren, Malmo (SE)

(73) Assignee: Fiedler & Lundgren AB, Malmö (SE)

( * ) Notice: Subject to any disclaimer, the term of this patent is extended or adjusted under 35 U.S.C. 154(b) by 0 days.

(21) Appl. No.: 15/735,539

(22) PCT Filed: Jun. 1, 2016

(86) PCT No.: PCT/EP2016/062386
§ 371 (c)(1),
(2) Date: Dec. 11, 2017

(87) PCT Pub. No.: WO2016/202591
PCT Pub. Date: Dec. 22, 2016

(65) Prior Publication Data

US 2018/0168222 A1 Jun. 21, 2018

(30) Foreign Application Priority Data

Jun. 16, 2015 (GB) ..... 1510503.4

(51) Int. Cl.
*B65D 21/08* (2006.01)
*A24F 23/00* (2006.01)
(Continued)

(52) U.S. Cl.
CPC ..... *A24F 23/00* (2013.01); *B65D 21/08* (2013.01); *B65D 51/28* (2013.01); *B65D 83/0888* (2013.01)

(58) Field of Classification Search
CPC .... B65D 21/08; B65D 21/086; B65D 21/083; B65D 83/0888; B65D 51/28; A24F 23/00
(Continued)

(56) References Cited

U.S. PATENT DOCUMENTS 1,630,437 A 5/1927 Kjellstrom
2,657,802 A 11/1953 Reed
(Continued)

FOREIGN PATENT DOCUMENTS

CA 2223335 A1 6/1999
CA 2252215 A1 5/2000
(Continued)

OTHER PUBLICATIONS

"International Preliminary Report on Patentability", PCT/EP2016/062386 dated Dec. 19, 2017.
(Continued)

*Primary Examiner* — Steven A. Reynolds
(74) *Attorney, Agent, or Firm* — McKee, Voorhees & Sease, PLC

(57) ABSTRACT

A container includes a base and a lid defining a first compartment therebetween for storing unused snus, wherein at least the lid or the base includes a reconfigurable wall to enable a user to form or enlarge a second compartment for storing used snus on the other side of said wall to the first compartment. The reconfigurable wall is formed of contiguous polygons configured to move relative to a boundary of the reconfigurable wall and relative to each other under applied pressure so as to be arrangeable in a first, convex configuration and arrangeable in a second, concave configuration. The second compartment is formed or enlarged when the contiguous polygons are arranged in the second, concave configuration.

19 Claims, 3 Drawing Sheets

(51) Int. Cl.
*B65D 83/08* (2006.01)
*B65D 51/28* (2006.01)

(58) Field of Classification Search
USPC ..... 206/242; 220/8, 530; 229/101
See application file for complete search history.

(56) References Cited

U.S. PATENT DOCUMENTS

| | | | | |
|---|---|---|---|---|
| 3,348,724 | A | 10/1967 | Rosso | |
| 3,351,225 | A | 11/1967 | Speas et al. | |
| 3,419,198 | A | 12/1968 | Pettersen | |
| 3,426,939 | A | 2/1969 | Young | |
| 3,483,908 | A * | 12/1969 | Donovan | B65D 1/34 206/526 |
| 3,910,444 | A | 10/1975 | Foster | |
| 4,089,421 | A | 5/1978 | Porter | |
| 4,165,815 | A | 8/1979 | Vetter | |
| 4,607,768 | A | 8/1986 | Taber et al. | |
| 4,770,318 | A | 9/1988 | Earl | |
| 4,879,442 | A * | 11/1989 | Giovine | B65D 83/0888 206/233 |
| 4,898,292 | A | 2/1990 | VerWeyst et al. | |
| 4,901,892 | A | 2/1990 | Song | |
| 5,791,473 | A | 8/1998 | Decker et al. | |
| 6,006,937 | A | 12/1999 | Baravaglio et al. | |
| 6,158,632 | A | 12/2000 | Ekkert | |
| 6,162,516 | A | 12/2000 | Derr | |
| D515,439 | S | 2/2006 | Pace | |
| 7,798,319 | B1 | 9/2010 | Bried et al. | |
| D640,546 | S | 6/2011 | Berggren | |
| 8,061,548 | B1 * | 11/2011 | Peggs | B65D 83/04 206/538 |
| D650,269 | S | 12/2011 | Berggren | |
| D660,693 | S | 5/2012 | Berggren | |
| 8,348,083 | B2 | 1/2013 | Light | |
| 8,881,896 | B2 * | 11/2014 | Gibson | A24F 23/00 206/236 |
| 9,538,785 | B2 | 1/2017 | Loos et al. | |
| 2003/0066165 | A1 | 4/2003 | Hansen, II et al. | |
| 2003/0172949 | A1 | 9/2003 | Alexander et al. | |
| 2005/0173272 | A1 | 8/2005 | Lemmons, IV | |
| 2005/0175741 | A1 * | 8/2005 | Reinders | B65D 21/08 426/106 |
| 2007/0095356 | A1 | 5/2007 | Winterson et al. | |
| 2007/0175909 | A1 | 8/2007 | Solowiejko | |
| 2007/0228051 | A1 | 10/2007 | Meroni | |
| 2009/0014450 | A1 | 1/2009 | Bjorkholm | |
| 2010/0064077 | A1 | 3/2010 | Chung | |
| 2011/0290682 | A1 * | 12/2011 | Gibson | A24F 23/00 206/265 |
| 2012/0168329 | A1 | 7/2012 | Berggren | |
| 2012/0181276 | A1 * | 7/2012 | Ichikawa | A61J 1/03 220/200 |
| 2014/0069829 | A1 * | 3/2014 | Evans | A24F 23/02 206/265 |
| 2018/0086518 | A1 * | 3/2018 | Charm | B65D 50/04 |

FOREIGN PATENT DOCUMENTS

| | | | |
|---|---|---|---|
| CA | 2536131 | A1 | 2/2005 |
| CA | 2743082 | A1 | 6/2010 |
| EP | 0104280 | A1 | 4/1984 |
| EP | 0611167 | B1 | 8/1994 |
| EP | 0954478 | B1 | 11/1999 |
| EP | 1667541 | B1 | 6/2006 |
| EP | 2308769 | A1 | 4/2011 |
| EP | 2349853 | B1 | 8/2011 |
| EP | 2540641 | B1 | 1/2013 |
| EP | 2712350 | A1 | 4/2014 |
| EP | 2767484 | A1 | 8/2014 |
| EP | 2813440 | A1 | 12/2014 |
| EP | 2861504 | B1 | 4/2015 |
| FR | 2873353 | A1 | 1/2006 |
| GB | 2147875 | A | 5/1985 |
| GB | 2221443 | A | 2/1990 |
| GB | 2513163 | A | 10/2014 |
| GB | 2513164 | A | 10/2014 |
| JP | 61216 | U | 1/1994 |
| JP | 06045496 | U | 6/1994 |
| JP | 8244747 | A | 9/1996 |
| JP | 3070156 | U | 7/2000 |
| JP | 2012510260 | A | 5/2012 |
| NO | 324584 | B2 | 11/2007 |
| SE | 527350 | C2 | 2/2006 |
| WO | 9625337 | A1 | 8/1996 |
| WO | 9829315 | A1 | 7/1998 |
| WO | 0147380 | A1 | 7/2001 |
| WO | 02076844 | A1 | 10/2002 |
| WO | 2003074385 | A1 | 9/2003 |
| WO | 2005016036 | A1 | 2/2005 |
| WO | 2006101876 | A2 | 9/2006 |
| WO | 2008066288 | A1 | 6/2008 |
| WO | 2008066450 | A1 | 6/2008 |
| WO | 2010060723 | A1 | 6/2010 |
| WO | 2010060845 | A1 | 6/2010 |
| WO | 2011001284 | A1 | 1/2011 |
| WO | 2011039986 | A | 4/2011 |
| WO | 2013142671 | A1 | 9/2013 |
| WO | 2013185838 | A1 | 12/2013 |
| WO | 2014039786 | A1 | 3/2014 |
| WO | 2014200423 | A1 | 12/2014 |

OTHER PUBLICATIONS

The Northerner, Grovsnus White (Swedish Portion Snus), http://www.northerner.com/products/swm884.html, 1 page, downloaded Oct. 7, 2011.

The Northerner, Combi Lid for Tobacco Snuff Cans, http://www.northerner.com/products/swm8810.html, 1 page, downloaded Oct. 14, 2011.

* cited by examiner

CONTAINER

CROSS-REFERENCE TO RELATED APPLICATIONS

This application is the National Stage of International Application No. PCT/EP2016/062386, filed Jun. 1, 2016, which claims priority to and benefit of Great Britain Patent Application No. 1510503.4, filed Jun. 16, 2015, all of which are herein incorporated by reference in their entirety for all purposes.

BACKGROUND

Field of the Disclosure

The present invention relates to a container for snus.

Description of the Related Art

The "background" description provided herein is for the purpose of generally presenting the context of the disclosure. Work of the presently named inventors, to the extent it is described in the background section, as well as aspects of the description which may not otherwise qualify as prior art at the time of filing, are neither expressly or impliedly admitted as prior art against the present invention.

Snus may be sold either in loose form or in portions disposed in permeable bags and it is packaged in boxes having a resealable lid so to maintain the snus moist. Snus is typically consumed by placing it under the upper lip for an extended period of time, thereafter it should preferably be disposed of in a suitable place such as a bin or the like to avoid littering. However, littering of snus is a common problem as, unlike cigarette smoking, consumption of snus is not restricted to a designated area and so a user may not always be in the vicinity of a bin so as to discard used snus.

To overcome the above mentioned problem, it is known to provide containers holding unused snus, wherein the container also comprises a separate compartment for temporarily receiving consumed snus until the user has access to an appropriate bin. However, one of the disadvantages of such a container is that the container is either packaged with less unused snus than a standard container of similar dimensions due to the incorporated second compartment imposing on the space for holding unused snus or, the container must be larger than normal so as to provide an empty separate compartment for receiving used snus.

One proposed solution for dealing with this problem is to provide a container comprising a movable wall which is movable from a first predetermined position to a second predetermined position so as to form the second compartment for storing used snus. This allows a user of the container to form the second compartment only when it is required (for example, when the user has finished using a snus pouch and is not close to a bin). This results in a more efficient use of space in the container. However, existing movable wall arrangements can be cumbersome and inconvenient for the user. For example, they will generally require the user to push on a specific section or area of the wall so as to move the wall from the first to the second position. If the user pushes on a different section or area of the wall, then the wall may not move or may move only partially to the second position, thus causing inconvenience for the user. Furthermore, there is a desire for a movable wall arrangement in which the shape of the formed second compartment is such that it is easier to remove used snus from the second compartment than with existing movable wall arrangements.

The present invention aims to alleviate the above-mentioned problems.

SUMMARY

The present invention provides a container comprising a base and a lid defining a first compartment therebetween for storing unused snus, wherein at least the lid or the base includes a reconfigurable wall to enable a user to form or enlarge a second compartment for storing used snus on the other side of said wall to the first compartment, wherein: the reconfigurable wall is formed of contiguous polygons configured to move relative to a boundary of the reconfigurable wall and relative to each other under applied pressure so as to be arrangeable in a first, convex configuration and arrangeable in a second, concave configuration, the second compartment being formed or enlarged when the contiguous polygons are arranged in the second, concave configuration.

All the contiguous polygons may be of the same type. In this case, the polygons may all be of the same size and shape, or alternatively, at least two of the polygons may be of a different size and/or shape to each other. Alternatively, the contiguous polygons may comprise at least two types of polygon.

The contiguous polygons may comprise a first polygon surrounded by a plurality of second polygons. All of the second polygons may be of the same type. In this case, the second polygons may all be of the same size and shape or, alternatively, at least two of the second polygons may be of a different size and/or shape to each other. Alternatively, the second polygons may comprise at least two types of polygon.

The first polygon may be a regular polygon and all the second polygons may be of the same type. In this case, the second polygons may all be of the same size and shape, or, alternatively, at least two of the second polygons may be of a different size and/or shape to each other. Alternatively, the second polygons may comprise at least two types of polygon.

The first polygon may be an irregular polygon and all the second polygons may be of the same type. Alternatively, the second polygons may comprise at least two types of polygon.

Each second polygon may be an isosceles trapezoid and the first polygon may be a regular polygon. The regular polygon may have 5, 6, 7, 8, 9, 10, 11, 12, 13, 14, 15 or 16 sides. In particular, the regular polygon may have 6 or 8 sides. The shortest of the parallel sides of each isosceles trapezoid may be contiguous with one of the sides of the first polygon. The longest of the parallel sides of each isosceles trapezoid may be disposed opposite one of the sides of the first polygon. The longest of the parallel sides of each isosceles trapezoid may form a portion of the boundary of the reconfigurable wall. Each isosceles trapezoid may be contiguous with its neighbouring isosceles trapezoids along its non-parallel sides. The isosceles trapezoids may be all of the same size and shape. Alternatively, at least two of the isosceles trapezoids may be of a different size and/or shape to each other.

Each second polygon may be an isosceles trapezoid and the first polygon may be an irregular polygon. The irregular polygon may have 5, 6, 7, 8, 9, 10, 11, 12, 13, 14, 15 or 16 sides. In particular, the irregular polygon may have 6 or 8 sides. The shortest of the parallel sides of each isosceles trapezoid may be contiguous with one of the sides of the first polygon. The longest of the parallel sides of each isosceles trapezoid may be disposed opposite one of the sides of the first polygon. The longest of the parallel sides of each isosceles trapezoid may form a portion of the boundary of the reconfigurable wall. Each isosceles trapezoid may be contiguous with its neighbouring isosceles trapezoids along its non-parallel sides.

The second compartment of the container may be defined by a side wall and the reconfigurable wall. The side wall may be connected to the reconfigurable wall at the boundary of the reconfigurable wall. In this case, the side wall may be resiliently flexible in response to force applied to the side wall at the boundary of the reconfigurable wall during reconfiguration of the reconfigurable wall between the first, convex configuration and the second, concave configuration.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE EMBODIMENTS

Figure 1:
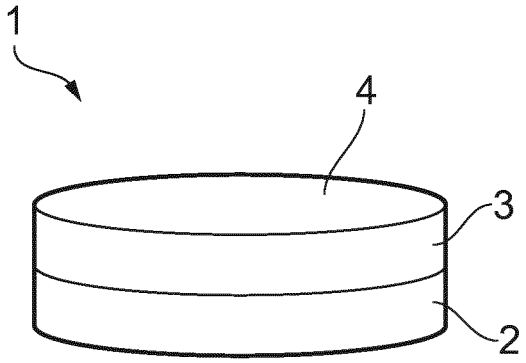
FIG. 1 shows a container according to an embodiment of the present invention.

Referring now to the drawings, wherein like reference numerals designate identical or corresponding parts throughout the several views.

Figure 2:
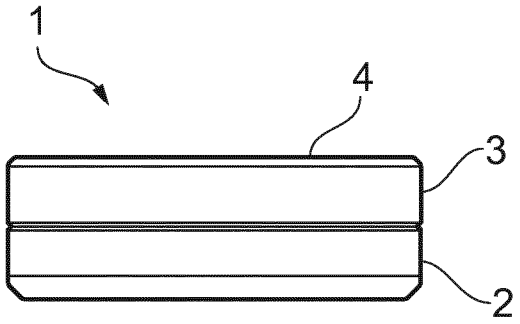
FIG. 2 shows the container from a different perspective.

FIGS. 1 and 2 show a container 1 according to an embodiment of the present invention. The container 1 comprises a base 2, lid 3 and a cover 4. As will be described later on, the base 2 and the lid 3 define a first space or compartment for storing fresh or unused snus, and the lid 3 and the cover 4 define a second space or disposal compartment for holding consumed or used snus.

Figure 3:
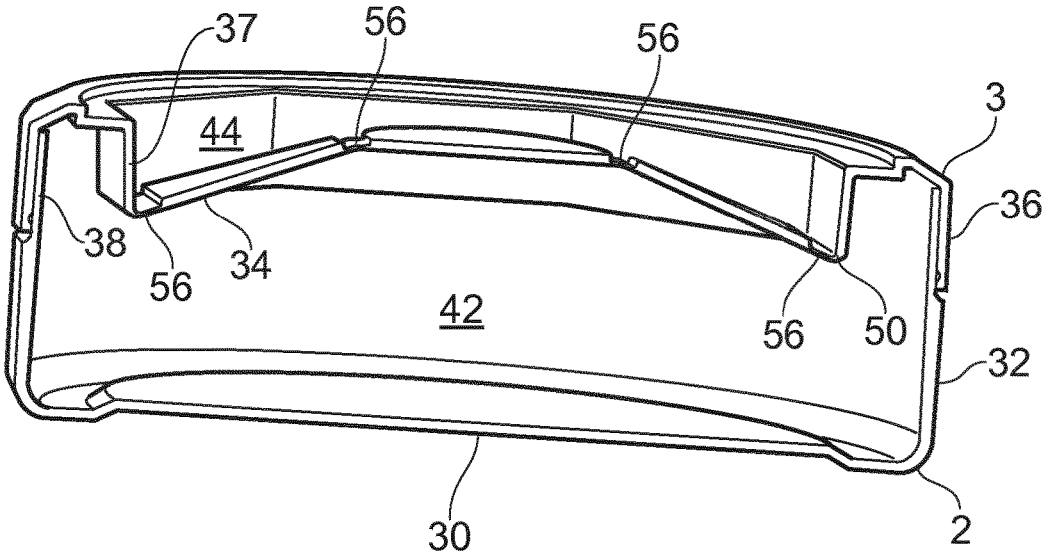
FIG. 3 shows a cross-section of the container.

FIG. 3 shows a cross-section of the container 1. The base 2 comprises a circular bottom wall 30 and a peripheral side wall 32. The lid 3 comprises a reconfigurable wall 34 and a peripheral side wall 36. An upper portion 38 of the base peripheral side wall 32 has a smaller outer diameter compared to the inner diameter of the lid peripheral side wall 36. This allows the base 2 to receive the lid 3, the lid 3 being releasably attachable to the base 2.

The base 2 and lid 3 define a first compartment 42 for receiving unused snus. A user is thus able to obtain a piece of unused snus from the first compartment 42 by removing the lid 3 from the base 2. The user will then typically re-attach the lid 3 to the base 2 so that the remaining unused snus remains moist. In addition, the lid 3 comprises a second compartment 44 for receiving used snus. The second compartment 44 is closable with the cover 4 (not shown in FIG. 3) so as to prevent the used snus from falling out of the second compartment. The lid comprises a reconfigurable wall 34 which separates the first and second compartments. That is, the first compartment 42 is on one side of the reconfigurable wall 34 and the second compartment 44 is on the other side of the reconfigurable wall 34. In fact, the reconfigurable wall 34, together with side wall 37, defines the second compartment. The reconfigurable wall 34 is described in more detail below.

Figure 4:
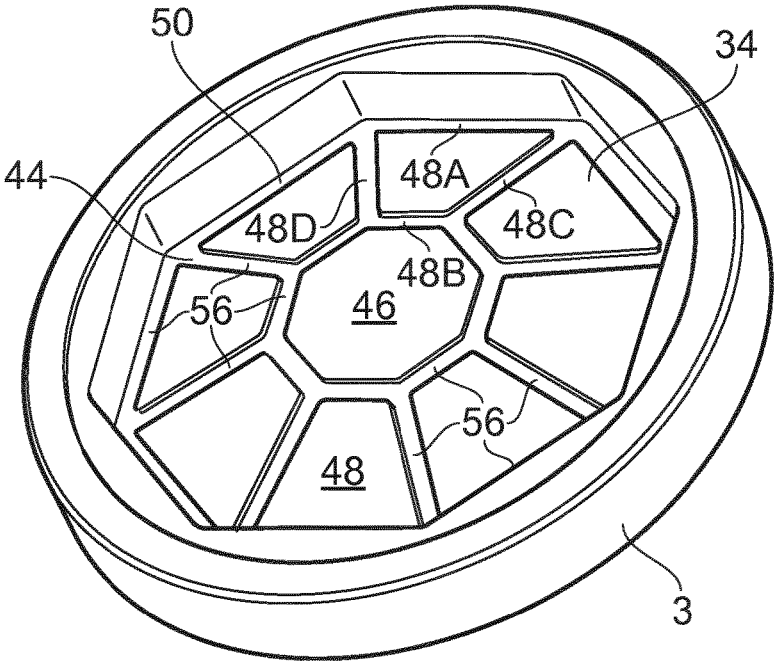
FIG. 4 shows a lid of the container.

FIG. 4 shows a perspective view of the lid 3 comprising the second compartment 44 and reconfigurable wall 34. The reconfigurable wall 34 is formed of contiguous polygons. All of the contiguous polygons may be of the same type (the type of a polygon being determined by the number of sides it has, so that two polygons with the same number of sides are polygons of the same type). For example, all of the contiguous polygons may be triangles. In this case, all the contiguous polygons may be of the same size and shape (that is, congruent with each other) or, alternatively, at least two of the contiguous polygons may have a different size and/or shape to each other (that is, at least two of the contiguous polygons may be non-congruent). Alternatively, the contiguous polygons may comprise at least two types of polygon.

The contiguous polygons may comprise a first polygon surrounded by a plurality of second polygons. This is the case in the embodiment shown in FIG. 4, in which there is a first polygon 46 surrounded by a plurality of second polygons 48. Each of the second polygons may be of the same type In this case, all the second polygons may be of the same size and shape (that is, congruent with each other—this is the case in the embodiment of FIG. 4) or, alternatively, at least two of the second polygons may have a different size and/or shape to each other (that is, at least two of the second polygons may be non-congruent). Alternatively, the second polygons may comprise at least two types of polygon.

In the embodiment of FIG. 4, the first polygon 46 is a regular polygon and the second polygons 38 are isosceles trapezoids of the same size and shape. The shortest of the parallel sides 48B of each isosceles trapezoid is contiguous with one of the sides of the first polygon. The longest of the parallel sides 48A of each isosceles trapezoid is disposed opposite one of the sides of the first polygon. In this embodiment, the longest of the parallel sides 48A of each isosceles trapezoid also forms a portion of the boundary 50 of the reconfigurable wall 34 (meaning that the boundary 50 of the reconfigurable wall 34 has the same regular polygonal shape as the first polygon 46). Each isosceles trapezoid is contiguous with its neighbouring isosceles trapezoids along its non-parallel sides 48C, 48D. Although the first polygon 46 in the embodiment of FIG. 4 is a regular octagon, it will be appreciated that any polygon, regular or irregular, may be used for the first polygon 46, and that the number and size and shape of the second polygons 48 will be adjusted accordingly so as to maintain the contiguous relationship between the polygons and form the reconfigurable wall 34. It is noted that the reconfigurable wall 34 is connected to the side wall 37 at its boundary 50, and the relative movement of the contiguous polygons 46, 48 is constrained at this boundary 50 of the reconfigurable wall 34.

The reconfigurable wall 34 is reconfigurable between a first configuration in which the contiguous polygons 46, 48 are arranged to form a convex shape and a second configuration in which the contiguous polygons 46, 58 are arranged to form a concave shape. In the first configuration, the convex shape serves to maximise the volume of the first compartment for storing unused snus. In the second configuration, the concave shape serves to maximise the volume of the second compartment for storing used snus. The reconfigurable wall 34 is reconfigurable between the first and second positions in response to pressure applied by the user, as will now be described with reference to FIGS. 5A and 5B.

Figure 5A:
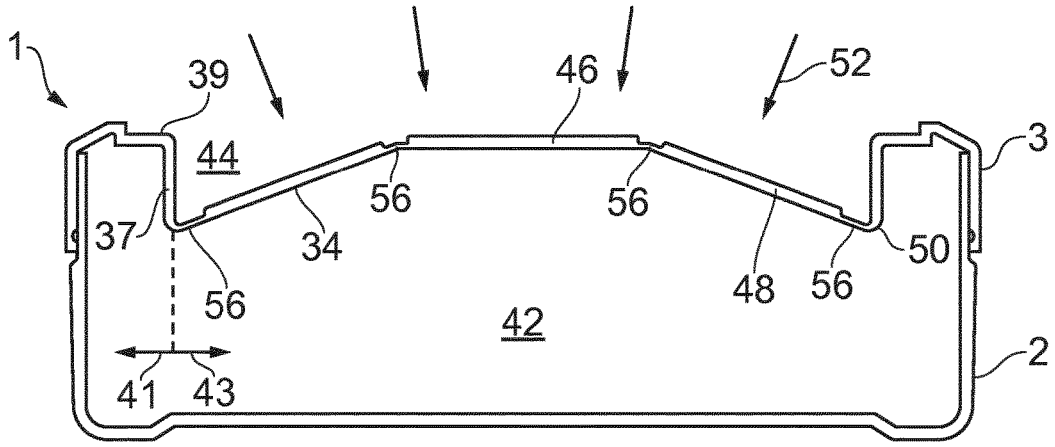
FIGS. 5A and 5B show a simplified cross-section of the container when the lid is attached to a base of the container.
Figure 5B:
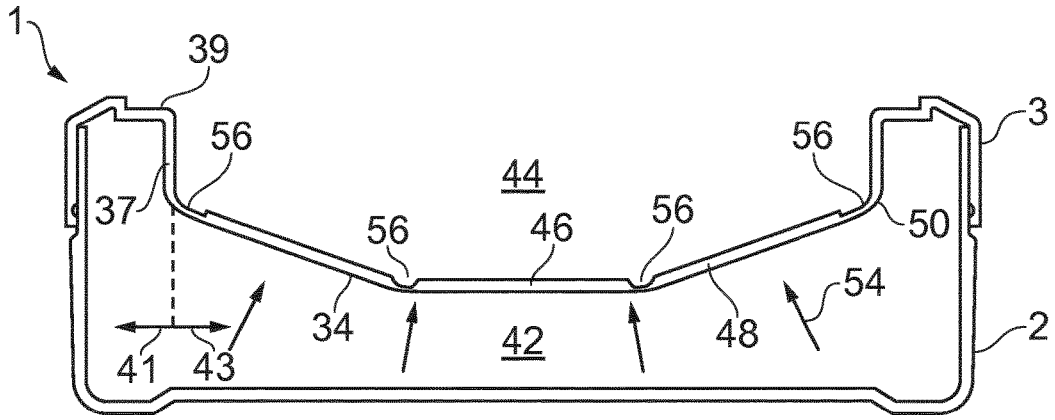

FIGS. 5A and 5B show a simplified cross-section of the container 1 when the lid 3 is attached to the base 2. FIG. 5A shows the reconfigurable wall 34 in the first configuration, in which the contiguous polygons 46, 48 are arranged to form a convex shape so as to maximise the volume of the first compartment 42. FIG. 5B shows the reconfigurable wall 34 in the second configuration, in which the contiguous polygons 46, 48 are arranged to form a concave shape so as to maximise the volume of the second compartment 44.

The reconfigurable wall 34 is reconfigurable from the first configuration of FIG. 5A to the second configuration of FIG. 5B when the user applies pressure to the reconfigurable wall 34 in a direction indicated by the arrows 52 in FIG. 5A. More specifically, once the pressure applied to the reconfigurable wall 34 in the direction of the arrows 52 exceeds a threshold value, the resilience of the reconfigurable wall 34 at the boundaries of the contiguous polygons 46, 48 is overcome. This causes the contiguous polygons 46, 48 to move relative to the boundary 50 of the reconfigurable wall and relative to each other to form the concave shape of the second configuration of FIG. 5B.

It is noted that the pressure in the direction of the arrows 52 may be applied directly so as to reconfigure the reconfigurable wall 34. For example, the user may apply pressure directly by pressing the reconfigurable wall 34 with one or more of their fingers. Alternatively, the pressure in the direction of the arrows 52 may be applied indirectly so as to reconfigure the reconfigurable wall 34. For example, when the reconfigurable wall 34 is in the first configuration of FIG. 5A, the user may place used snus in the compartment 44 and then attach the cover 4 to the lid 3. If there is a sufficient amount of used snus placed in the compartment 44, then as the cover 4 is attached to the lid 3 by the user, the cover will push against the used snus and, in turn, the used snus will push against the reconfigurable wall. Thus, pressure is applied indirectly to the reconfigurable wall 34 via the used snus as the cover 4 is attached to the lid 3.

Similarly, the reconfigurable wall 34 is reconfigurable from the second configuration of FIG. 5B to the first configuration of FIG. 5A when the user applies pressure to the reconfigurable wall 34 in a direction indicated by the arrows 54 in FIG. 5B (in this case, the user must remove the lid 3 from the base 2 in order to apply pressure to the reconfigurable wall 34). More specifically, once the pressure applied to the reconfigurable wall 34 in the direction of the arrows 54 exceeds the threshold value, the resilience of the reconfigurable wall 34 at the boundaries of the contiguous polygons 46, 48 is overcome. This causes the contiguous polygons 46, 48 to move relative to the boundary 50 of the reconfigurable wall and relative to each other to form the convex shape of the first configuration of FIG. 5A.

Again, it is noted that the pressure in the direction of the arrows 54 may be applied directly so as to reconfigure the reconfigurable wall 34. For example, the user may apply pressure directly by pressing the reconfigurable wall 34 with one or more of their fingers. Alternatively, the pressure in the direction of the arrows 54 may be applied indirectly so as to reconfigure the reconfigurable wall. For example, if the reconfigurable wall 34 is in the second configuration of FIG. 5B before the lid 3 is attached to the base 2, and if there is a sufficient amount of unused snus placed in the compartment 42, then as the lid 3 is attached to the base 2 by the user (or, alternatively, by the manufacturer), the unused snus will push against the reconfigurable wall 34. Thus, pressure is applied indirectly to the reconfigurable wall 34 via the unused snus as the lid 3 is attached to the base 2.

The contiguous polygons 46, 48 are defined by resilient portions 56 of the reconfigurable wall 34. More specifically, the resilient portions 56 define the boundaries of the contiguous polygons 46, 48. The resilient portions 56 enable the above-mentioned relative movement of the contiguous polygons by allowing each polygon to undertake a pivoting or hinging motion about each of its boundaries. The resilient portions 56 also bias the relative movement of the contiguous polygons such that the first and second configurations are stable (that is, non-changing) in the absence of applied pressure (or when the applied pressure is less than the threshold value). When sufficient pressure is applied so as to reconfigure the reconfigurable wall 34 from the first configuration to the second configuration (or vice versa), the resilience of the resilient portions 56 causes the configuration to change suddenly via a "pop" or "snap" action.

In addition to the resilient portions 56 of the reconfigurable wall 34 allowing the relative movement of the contiguous polygons and biasing the relative movement such that the first and second configurations are stable, the side wall 37 of the used snus compartment may also be resiliently flexible so as to help allow relative movement of the contiguous polygons and bias the relative movement such that the first and second configurations are stable. In this case, the side wall 37 is resiliently flexible in response to force applied to the side wall at the boundary 50 of the reconfigurable wall 34 during reconfiguration of the reconfigurable wall between the first, convex configuration and the second, concave configuration. This is illustrated in FIGS. 5A and 5B.

When pressure is applied to the reconfigurable wall in the direction of the arrows 52 in FIG. 5A so as to reconfigure the reconfigurable wall from the first configuration to the second configuration, a force is applied to the side wall 37 at the boundary 50 in the direction of the arrow 41. This causes the side wall to flex about its upper edge 39 (the upper edge 39 connecting the side wall 37 to the outer portion of the lid 3) in the direction of the arrow 41 so as to move away from its original position as the reconfigurable wall is initially reconfigured away from the first configuration. The resilience of the side wall 37 as it is flexed in the direction of the arrow 41 helps cause an initial resistance against the reconfiguration of the reconfigurable wall and helps bias the relative movement of the contiguous polygons such that the first configuration is stable. Then, as the reconfigurable wall approaches the second configuration (as occurs when the pressure applied to the reconfigurable wall by the user exceeds the threshold value required to overcome the resistance provided by the resilience of the resilient portions 56 and the side wall 37), the resilience of the side wall 37 causes the side wall to flex about is upper edge 39 in the direction of the arrow 43 so as to return to its original position (the original position of the side wall 37 being reached when the reconfigurable reaches the second configuration). As the side wall 37 returns to its original position under its own resilience, it applies a force to the boundary 50 of the reconfigurable wall which assists the reconfigurable wall in arriving at the second configuration.

Similarly, when pressure is applied to the reconfigurable wall in the direction of the arrows 54 in FIG. 5B so as to reconfigure the reconfigurable wall from the second configuration to the first configuration, a force is applied to the side wall 37 at the boundary 50 in the direction of the arrow 41. This causes the side wall to flex about its upper edge 39 (the upper edge 39 connecting the side wall 37 to the outer portion of the lid 3) in the direction of the arrow 41 so as to move away from its original position as the reconfigurable wall is initially reconfigured away from the second configuration. The resilience of the side wall 37 as it is flexed in the direction of the arrow 41 helps cause an initial resistance against the reconfiguration of the reconfigurable wall and helps bias the relative movement of the contiguous polygons such that the second configuration is stable. Then, as the reconfigurable wall approaches the first configuration (as occurs when the pressure applied to the reconfigurable wall by the user exceeds the threshold value required to overcome the resistance provided by the resilience of the resilient portions 56 and the side wall 37), the resilience of the side wall 37 causes the side wall to flex about is upper edge 39 in the direction of the arrow 43 so as to return to its original position (the original position of the side wall 37 being reached when the reconfigurable reaches the first configuration). As the side wall 37 returns to its original position under its own resilience, it applies a force to the boundary 50 of the reconfigurable wall which assists the reconfigurable wall in arriving at the first configuration.

Thus, together with the resilience of the resilient portions 56 of the reconfigurable wall, the resilience of the side wall 37 causes initial resistance to reconfiguration when pressure is initially applied to the reconfigurable wall followed by, once reconfiguration has been initiated (as occurs when the pressure applied to the reconfigurable wall exceeds the predetermined threshold), assistance in reconfiguring the reconfigurable wall to its final, new configuration. It is this initial resistance followed by subsequent assistance which results in the "pop" or "snap" action as the reconfigurable wall is reconfigured between the first and second configurations. Note that the resistance provided by the resilient portions 56 and resilient side wall 37 will change to become assistance once the reconfigurable wall reaches approximately half way between the first and second configurations (that is, when the reconfigurable wall is approximately planar and is parallel to the planar base 30 of the container 1).

In the embodiment shown in the Figures, the entire lid 3, including the reconfigurable wall 34, is formed from a single material. The thickness of the material is reduced in predetermined regions of the reconfigurable wall 34 so as to define the resilient portions 56 at the boundaries of the contiguous polygons 46, 48. Advantageously, this allows for easy manufacture of the lid 3 by injection moulding or the like. The material used may be any material which has suitable resilience at reduced thickness, such as polyethylene (PE) or polypropylene (PP). It is noted that the side wall 37 will generally be less resilient than the resilient portions 56 (since, unlike the resilient portions 56, the side wall does not have to be sufficiently resilient so as to allow a well defined hinging or pivoting motion), and may, as in the example embodiments, be of the same or of a similar thickness as that of the central portion of each of the contiguous polygons 46, 48 (that is, the portion of each contiguous polygon which does not form part of the resilient portion 56). Advantageously, such a thickness allows the side wall to be sufficiently resilient so as to provide appropriate resistance and assistance during reconfiguration of the reconfigurable wall (as described above) whilst, at the same time, help provide structural integrity to the lid 3.

In use, when the container 1 is initially filled with new, unused snus, the reconfigurable wall 34 is made to take the first, convex configuration of FIG. 5A. This provides maximum volume in the first compartment 42 for storing unused snus. At a later time, when the user wishes to store used snus in the container 1 (until they can find a suitable waste receptacle), the user places the used snus in the second compartment 44. In order to increase the volume of the second compartment 44 so as to enable more used snus to be stored, the user applies pressure to the reconfigurable wall 34 so that it "pops" or "snaps" into the second, concave configuration of FIG. 5B. At an even later time, once the user has found a suitable waste receptacle to dispose of the used snus, the user may then apply pressure to the reconfigurable wall 34 so that it "pops" or "snaps" back to the first, convex configuration of FIG. 5A. This once again provides a maximum volume in the first compartment 42, which the user may refill with new, unused snus. Thus, advantageously, the reconfigurable wall 34 allows the total volume of the container 1 to be efficiently used depending on the relative amounts of used and unused snus.

Advantageously, the above-described reconfigurable wall 34 comprising contiguous polygons allows the user to apply pressure to any region of the reconfigurable wall in order to reconfigure the wall from the first configuration to the second configuration (or vice versa). This is because the use of such contiguous polygons allows the pressure applied to the reconfigurable wall 34 to be more evenly distributed across the reconfigurable wall 34 when the pressure is applied to one or more of the polygons. Thus, the user is able to easily reconfigure the reconfigurable wall 34 by applying pressure to any one contiguous polygon (that is, to any point on the reconfigurable wall 34). This makes it easier and more convenient for the user to reconfigure the reconfigurable wall 34. This is particularly the case for a polygon arrangement in which a first polygon 46 is surrounded by a plurality of second polygons 48, and more particularly when the second polygons 48 are all of the same type (as shown in the described embodiments).

Furthermore, the above-described reconfigurable wall 34 comprising contiguous polygons including a first polygon 46 surrounded by a plurality of second polygons 48, each of the second polygons being of the same type, provides a favourable shape to the first and second compartments 42, 44. In particular, this is true of the second compartment 44, for which the concave shape of the reconfigurable wall 34 in the second configuration allows used snus to be easily removed from the second compartment 44 when the user finds a suitable waste receptacle for disposing of the used snus.

The use of a regular polygon as the first polygon 46 and a plurality of identical isosceles trapezoids as the plurality of second polygons 48 is particular effective at allowing pressure to be more evenly distributed across the reconfigurable wall 34 and at achieving the above-mentioned effects. Any regular polygon may be used as the first polygon 46, the number of isosceles trapezoids as the second polygons 48 being equal to the number of sides of the chosen regular polygon. The use of a regular polygon with 5, 6, 7, 8, 9, 10, 11, 12, 13, 14, 15 or 16 sides is particular advantageous, since this allows a well defined convex and concave shape of the first and second wall configurations (respectively) whilst maintaining structural integrity of the wall and ease of manufacture (due to obtaining a favourable balance between the resilient portions of the reconfigurable wall at the boundaries of the contiguous polygons and the harder, less resilient portions of the reconfigurable wall defining the central portions of the contiguous polygons). In fact, the use of a regular polygon with 6 or 8 sides is particularly effective.

It is noted that, in the embodiment shown in the Figures, the second compartment 44 always exists, but has a smaller volume when the reconfigurable wall 34 is in the first, convex configuration of FIG. 5A. In an alternative embodiment, the reconfigurable wall may be positioned such that the second compartment 44 is only formed when the reconfigurable wall 34 is reconfigured from the first, convex configuration to the second, concave configuration (that is, the second compartment 44 has zero volume when the reconfigurable wall 34 is in the first, convex configuration).

It is noted that the arrangement of the container 1 relates to only one embodiment of the invention, and that the reconfigurable wall 34 and first and second compartments may be arranged differently. For example, instead of being located in the lid 3, the second compartment 44 may instead be located in the base 2. In this case, the circular bottom wall 30 of the base 2 may instead comprise the reconfigurable wall 34, which, together with a side wall (not shown, but similar to the side wall 37 in the embodiment of the Figures), defines the second compartment 44 in a bottom portion of the base 2. The second compartment 44 will then be closable with a separate bottom cover (not shown) so as to prevent the used snus from falling out.

In this alternative arrangement, the entire base 2, including the reconfigurable wall 34 and side wall 37, may be formed from a single material (as is the case for the lid 3 when the lid 3 comprises the reconfigurable wall 34, as previously described). The thickness of the material is again reduced in predetermined regions of the reconfigurable wall 34 so as to define the resilient portions 56 at the boundaries of the contiguous polygons 46, 48. Advantageously, this allows for easy manufacture of the base 2 by injection moulding or the like. The material used may again be any material which has suitable resilience at reduced thickness, such as polyethylene (PE) or polypropylene (PP).

Of course, further different configurations of the container 1 are also possible.

Obviously, numerous modifications and variations of the present disclosure are possible in light of the above teachings. It is therefore to be understood that within the scope of the appended claims, the disclosure may be practiced otherwise than as specifically described herein.

Although the present disclosure has been described in connection with some embodiments, it is not intended to be limited to the specific form set forth herein. Additionally, although a feature may appear to be described in connection with particular embodiments, one skilled in the art would recognize that various features of the described embodiments may be combined in any manner suitable to implement the technique.

The invention claimed is:

1. A container comprising a base and a lid defining a first compartment therebetween for storing unused snus, wherein at least the lid or the base includes a reconfigurable wall to enable a user to form or enlarge a second compartment for storing used snus on the other side of said wall to the first compartment, wherein:

the reconfigurable wall is formed of contiguous polygons configured to move relative to a boundary of the reconfigurable wall and relative to each other under applied pressure so as to be arrangeable in a first, convex configuration and arrangeable in a second, concave configuration, the second compartment being formed or enlarged when the contiguous polygons are arranged in the second, concave configuration, wherein the said relative movement of the contiguous polygons is a snap action from the first, convex configuration to the second, concave configuration or from the second, concave configuration to the first, convex configuration.

2. A container according to claim 1, wherein all the contiguous polygons are of the same type.

3. A container according to claim 1, wherein the contiguous polygons comprise at least two types of polygon.

4. A container according to claim 3, wherein the contiguous polygons comprise a first polygon surrounded by a plurality of second polygons.

5. A container according to claim 3, wherein all the second polygons are of the same type.

6. A container according to claim 5, wherein each second polygon is an isosceles trapezoid.

7. A container according to claim 6, wherein:

the shortest of the parallel sides of each isosceles trapezoid is contiguous with one of the sides of the first polygon.

8. A container according to claim 6, wherein the longest of the parallel sides of each isosceles trapezoid is disposed opposite one of the sides of the first polygon.

9. A container according to claim 8, wherein the longest of the parallel sides of each isosceles trapezoid forms a portion of the boundary of the reconfigurable wall.

10. A container according to claim 6, wherein each isosceles trapezoid is contiguous with its neighbouring isosceles trapezoids along its non-parallel sides.

11. A container according to claim 4, wherein the first polygon has 5, 6, 7, 8, 9, 10, 11, 12, 13, 14, 15 or 16 sides.

12. A container according to claim 11, wherein the first polygon has 6 or 8 sides.

13. A container according to claim 4, wherein the first polygon is a regular polygon.

14. A container according to claim 4, wherein the first polygon is an irregular polygon.

15. A container according to claim 4, wherein the second polygons are all of the same size and shape.

16. A container according to claim 4, wherein at least two of the second polygons have a different shape and/or size to each other.

17. A container according to claim 1, wherein:

the second compartment is defined by a side wall and the reconfigurable wall;

the side wall is connected to the reconfigurable wall at the boundary of the reconfigurable wall; and the side wall is resiliently flexible in response to force applied to the side wall at the boundary of the reconfigurable wall during reconfiguration of the reconfigurable wall between the first, convex configuration and the second, concave configuration.

18. A container comprising a base and a lid defining a first compartment therebetween for storing unused snus, wherein at least the lid or the base includes a reconfigurable wall to enable a user to form or enlarge a second compartment for storing used snus on the other side of said wall to the first compartment, wherein:

the reconfigurable wall is formed of contiguous polygons configured to move relative to a boundary of the reconfigurable wall and relative to each other under applied pressure so as to be arrangeable in a first, convex configuration and arrangeable in a second, concave configuration, the second compartment being formed or enlarged when the contiguous polygons are arranged in the second, concave configuration;

wherein the contiguous polygons comprise at least two types of polygon;

wherein all the second polygons are of the same type;

wherein each second polygon is an isosceles trapezoid; and wherein the shortest of the parallel sides of each isosceles trapezoid is contiguous with one of the sides of the first polygon.

19. A container comprising a base and a lid defining a first compartment therebetween for storing unused snus, wherein at least the lid or the base includes a reconfigurable wall to enable a user to form or enlarge a second compartment for storing used snus on the other side of said wall to the first compartment, wherein:

the reconfigurable wall is formed of contiguous polygons configured to move relative to a boundary of the reconfigurable wall and relative to each other under applied pressure so as to be arrangeable in a first, convex configuration and arrangeable in a second, concave configuration, the second compartment being formed or enlarged when the contiguous polygons are arranged in the second, concave configuration;

wherein the contiguous polygons comprise at least two types of polygon;

wherein the contiguous polygons comprise a first polygon surrounded by a plurality of second polygons; and wherein the first polygon has 5, 6, 7, 8, 9, 10, 11, 12, 13, 14, 15 or 16 sides.

* * * * *